US006351254B2

(12) United States Patent
Dinh et al.

(10) Patent No.: US 6,351,254 B2
(45) Date of Patent: Feb. 26, 2002

(54) JUNCTION-BASED FIELD EMISSION STRUCTURE FOR FIELD EMISSION DISPLAY

(75) Inventors: Long N. Dinh, Concord; Mehdi Balooch, Berkeley; William McLean, II, Oakland; Marcus A. Schildbach, Livermore, all of CA (US)

(73) Assignee: The Regents of the University of California

( * ) Notice: Subject to any disclaimer, the term of this patent is extended or adjusted under 35 U.S.C. 154(b) by 0 days.

(21) Appl. No.: 09/110,166

(22) Filed: Jul. 6, 1998

(51) Int. Cl.[7] ..... G09G 3/20; G09G 3/10; H01J 1/02

(52) U.S. Cl. ..... 345/75.2; 313/310; 315/169.3

(58) Field of Search ..... 345/74, 75; 313/308, 313/309, 310, 311, 422, 495; 315/169.1, 169.2, 169.3, 169.4; 257/10; 215/100; 423/446; 445/51

(56) References Cited

U.S. PATENT DOCUMENTS

| | | | | |
|---|---|---|---|---|
| 4,040,080 A | * | 8/1977 | Hara et al. | 257/10 |
| 4,506,284 A | | 3/1985 | Shannon | 257/10 |
| 5,138,237 A | * | 8/1992 | Kane et al. | 313/311 |
| 5,670,788 A | * | 9/1997 | Geis | 257/10 |
| 5,763,997 A | * | 6/1998 | Kumar | 313/309 |
| 5,804,910 A | * | 9/1998 | Tjaden et al. | 313/310 |
| 5,866,988 A | * | 2/1999 | Oda | 315/169.1 |
| 5,894,189 A | * | 4/1999 | Ogasawara et al. | 313/310 |
| 5,949,185 A | * | 9/1999 | Janning | 313/495 |
| 5,952,772 A | * | 9/1999 | Fox et al. | 313/310 |
| 5,962,959 A | * | 10/1999 | Iwasaki et al. | 313/310 |
| 5,977,697 A | * | 11/1999 | Jin et al. | 313/310 |
| 6,008,569 A | * | 12/1999 | Yamanobe | 313/310 |
| 6,011,356 A | * | 1/2000 | Janning et al. | 345/74 |

FOREIGN PATENT DOCUMENTS

| | | |
|---|---|---|
| BE | 679967 | 10/1966 |
| DE | 3035988 | 4/1982 |
| EP | 0287067 | 10/1988 |
| WO | WO9806135 | 2/1998 |

OTHER PUBLICATIONS

A. D. Cope et al, "Scanning–Beam Performance from a Negative–Electron–Affinity Activated Silicon Cold Cathode," RCA Review, vol. 34, Sep. 1973 (1973–09), pp. 408–428, XP002116867, pp. 408–428.

Elliott S. Kohn, "The Silicon Cold Cathode," IEEE Transactions on Electron Devices, vol. 20, NR.3, pp. 321–329, XP002006374.

Elliott S. Kohn, "The Silicon Cold Cathode from Silicon," Applied Physics Letters, vol. 18, No. 7, Apr. 1, 1971 (1971–04–01), pp. 272–273, XP002116868.

* cited by examiner

*Primary Examiner*—Steven Saras
*Assistant Examiner*—Paul Bell
(74) *Attorney, Agent, or Firm*—Alan H. Thompson; L. E. Carnahan

(57) ABSTRACT

A junction-based field emission display, wherein the junctions are formed by depositing a semiconducting or dielectric, low work function, negative electron affinity (NEA) silicon-based compound film (SBCF) onto a metal or n-type semiconductor substrate. The SBCF can be doped to become a p-type semiconductor. A small forward bias voltage is applied across the junction so that electron transport is from the substrate into the SBCF region. Upon entering into this NEA region, many electrons are released into the vacuum level above the SBCF surface and accelerated toward a positively biased phosphor screen anode, hence lighting up the phosphor screen for display. To turn off, simply switch off the applied potential across the SBCF/substrate. May be used for field emission flat panel displays.

18 Claims, 1 Drawing Sheet

JUNCTION-BASED FIELD EMISSION STRUCTURE FOR FIELD EMISSION DISPLAY

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to field emission displays, particularly to a junction-based field emission display, and more particularly to a field emission display which utilizes junctions formed by depositing a semiconducting or dielectric, low work function, negative electron affinity (NEA), silicon-based compound film (SBCF) onto a metal substrate or an n-type semiconductor substrate.

Field emission displays traditionally rely on electron emission from arrays of precisely manufactured sharp tips. The ease of electron emission, and therefore the reduction in energy consumption of the display, depends not only on the work functions of the materials used to fabricate the tips but also on the sharpness of the tips. Thus there has been a need for a field emission structure that provides a quick and inexpensive way to reduce drastically the voltages necessary to extract electrodes from the cathodes and to remove completely the requirement of fabricating sharp tips in field emission applications.

The present invention provides a solution to the above-mentioned need by providing a junction-based field emission structure which eliminates the use of sharp tips, reduces the voltages necessary to extract electrons, and provides an inexpensive field emission display. The field emission display of the present invention utilizes junctions formed by depositing a semiconducting or dielectric, low work function, preferably NEA SBCF onto a metal substrate or an n-type semiconductor substrate. A small forward bias voltage is applied across the junction so that electron transport is from the substrate into the SBCF region; and upon entering into this NEA region, many electrons are released into the vacuum adjacent the junction and accelerated toward a positively biased phosphor screen anode, lighting it up for display.

SUMMARY OF THE INVENTION

It is an object of the present invention to provide an improved field emission display.

A further object of the invention is to provide a junction-based field emission display.

A further object of the invention is to provide a field emission display which eliminates the use of sharp tips.

Another object of the invention is to provide a device for field emission applications which reduces the voltages necessary to extract electrons from the cathode.

Another object of the invention is to provide a field emission display which utilizes junctions formed by a semiconducting or dielectric, low work function, preferably NEA SBCF onto a metal or n-type semiconductor substrate.

Another object of the invention is to provide a junction-based field emission display using a silicon-based compound (SBC) deposited directly on either an n-type semiconductor or a metal substrate.

Another object of the invention is to provide a field emission device using an SBC, which consists of silicon, oxygen, and an alkali metal deposited on a metal or n-type semiconductor substrate.

Another object of the invention is to provide a junction-based field emission display wherein a small forward bias voltage is applied across the junction so that electron transport is from a substrate into an SBC causing release of electrons which are accelerated toward a positively biased phosphor screen anode.

Other objects and advantages of the present invention will become apparent from the following description and accompanying drawings. Broadly, the present invention is a junction-based field emission structure which provides a quick and inexpensive way to reduce drastically the voltages necessary to extract electrons from the cathode and to remove completely the requirement of fabricating sharp tips in field emission applications. The junction-based field emission device uses a semiconducting or dielectric and NEA SBCF deposited directly onto either an n-type semiconductor or a metal substrate. The SBCF can be doped to become a p-type semiconductor. The SBCF consists of silicon, oxygen, and an alkali metal, such as Cs or Ba, and is synthesized by the techniques of thermal vaporization and pulsed laser deposition. To light up a phosphor screen of a field emission display, such as a flat panel display, a forward bias voltage is applied across the junction so that electrons flow from the substrates into the SBCF region, and due to the NEA property of this region, many electrons immediately escape to the vacuum level and are accelerated toward the positively biased phosphor screen anode plate to light it up for display. To turn off the screen, simply switch off the applied voltage across the junction.

BRIEF DESCRIPTION OF THE DRAWINGS

The accompanying drawing, which is incorporated into and forms a part of the disclosure, illustrates an embodiment of the invention and, together with the description, serves to explain the principles of the invention.

DETAILED DESCRIPTION OF THE INVENTION

The present invention is directed to a junction-based field emission structure that provides a quick and inexpensive way to reduce drastically the voltages necessary to extract electrons from the cathodes and to remove completely the requirement of fabricating sharp tips in field emission applications. The invention involves a semiconducting or dielectric and NEA SBCF deposited directly onto either an n-type semiconductor or a metal substrate, and such has been shown to have excellent stability with varying temperature and environment. The SBC consists of silicon, oxygen, and an alkali metal, such as Cs, Ba, K, Rb, and Li, and is synthesized by the known techniques of thermal vaporization and pulsed laser deposition. The as-deposited SBC film (SBCF) region has an abundance of surface status in the band gap and may also be optionally doped to become a p-type semiconductor. For example, a dopant of Group II, such as In, B, or Ga, may be utilized to produce the p-type material. To light up a phosphor screen of a display device, a forward bias voltage is applied across the junction so that electrons flow from the substrate into the SBCF region. Due to the NEA property of this region, many electrons immediately escape to the vacuum level and head toward the phosphor screen anode plate placed above this diode structure, and hence light it up for display. To turn off the phosphor screen, one simply switches off the applied voltage across the junction.

Figure 1:
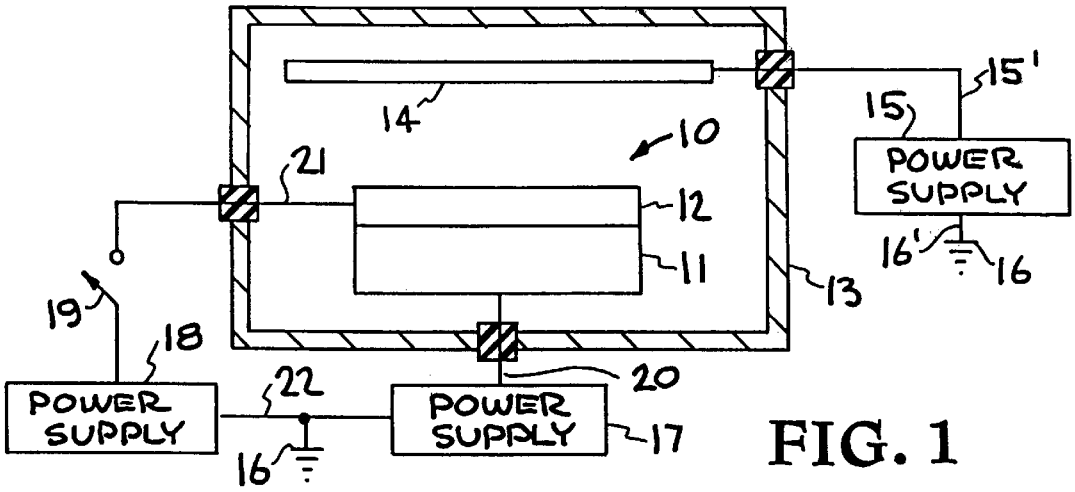
FIG. 1 schematically illustrates a single junction-based field emission display, in accordance with the present invention.

FIG. 1 schematically illustrates an embodiment of the junction-based field emission structure of the present invention. As shown, the structure comprises a junction generally indicated at 10, and composed of a substrate 11, which may be composed of metal, such as Al, Au, Pt, or Cu, or an n-type semiconductor (n-Si), and on which is deposited an SBCF 12, which film may be composed of silicon, oxygen, and CS, or another suitable alkali metal. The substrate 11 with deposited SBCF 12 (junction 10) is located in a vacuum case 13, and in spaced relation to a positively biased phosphor screen anode plate 14, plate 14 being positively biased by a power supply 15 connected intermediate the plate 14 and ground indicated at 16 by electrical leads 15' and 16'. A power supply 17 is connected between the substrate 11 and ground 16 and a power supply 18 is connected between the SBCF 12, via a switch 19, and ground 16 by electrical leads 20, 21, and 22, to produce a small forward bias voltage across the junction 10 so that electron transport is from the substrate 11 into SBCF region 12. Upon entering this NEA region 12, electrons are released into the vacuum case 13 and accelerated toward the positively biased phosphor screen anode plate 14, hence lighting it up for display. To turn off the phosphor screen, simply move the blade of switch 19 from the closed position to an open position.

By way of example, the substrate 11 may have a thickness of many micrometers to many millimeters, with the SBCF 12 having a thickness of a few micrometers down to 100 nanometers, the positive bias on the anode plate is in the range of 500 V to 5 KV, and the small forward bias voltage applied across the junction 10 is in the range of 0.5 to 5 volts, with the vacuum case 13 being at a pressure of $10^{-5}$ to $10^{-7}$ Torr, and with the phosphor screen anode plate 14 being located from the SBCF surface by a distance of less than 1 micrometer to about 20 micrometers.

Figure 2:
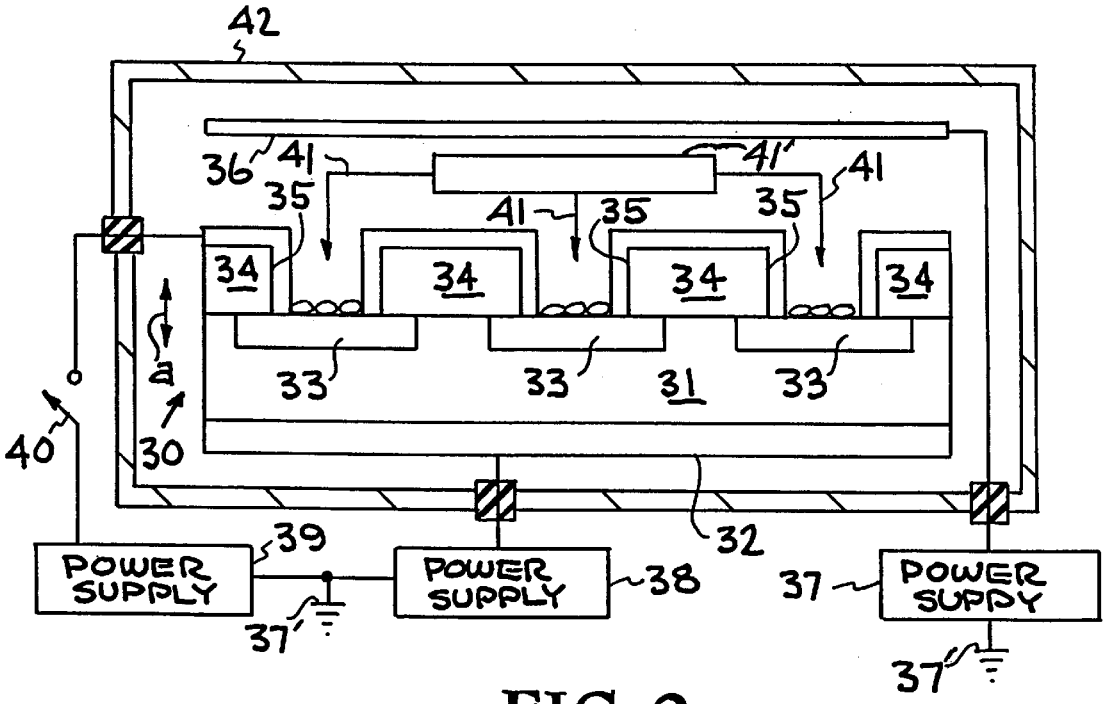
FIG. 2 schematically illustrates a multiple junction-based field emission display, in accordance with the invention.

FIG. 2 schematically illustrates a multiple junction-based field emission structure generally indicated at 30 composed of a substrate 31 of n-Si, and on one side of which is deposited a metal contact 32 to n-Si (Al or lower work function material to form an ohmic contact). A plurality of p-Si contacts 33 are formed in an opposite surface of substrate 31 and a layer 34 of $SiO_2$ having a thickness of >2 um, as indicted by arrow a, is deposited on that opposite side with openings 35 therein to expose the p-Si contacts or pads 33. In spaced relation to the substrate 31, a positively biased phosphor screen anode plate 36 is located, with plate 36 being positively biased by a power supply 37 connected intermediate plate 36 and ground indicted at 37'. A power supply 38 is connected between the metal contact 32 and ground 37', and a power supply 39 is connected between p-Si contacts or pads 33 via a switch 40 and ground 37' to produce a small forward bias voltage across the junctions so that electron transport is from the substrate 31 into the p-Si contacts 33, and Si/Cs/O nanoclusters indicated at 41 from a SBCF region 41' are released into a vacuum case 42 and accelerated toward the positively biased phosphor screen anode plate 36. To turn off the phosphor screen simply move the blade of switch 40 from the closed position to an open position.

Addressable and multiple junction-based field emission structures for display can be developed upon this primary single junction-based field emission structure of FIG. 1 by laying down an insulating layer on top of a properly marked substrate, followed by removing the mark and then depositing an SBCF. For an SBCF with a small band gap, a small bias voltage on the order of half the band gap is sufficient to turn on this junction-based field emitter. With such low turn-on voltage, the junction-based field emission structure of the present invention promises field emission flat panel displays with much lower turn-on voltages, low energy consumption, and therefore much simpler (and less expensive) power supplies than conventional structure. Because of its simpler geometry, there are fewer and easier manufacturing steps associated with the fabrication of addressable segments of cathode material suitable for incorporation in a flat panel display. Simpler manufacturing processes associated with this diode structure translate directly to lower costs, especially when compared to conventional gated tip (triode) arrays.

It has thus been shown that the present invention provides a junction-based field emission structure that eliminates the problems associated with sharp tip field emission structures, and the junction-based approach is simpler and less expensive to manufacture. The substrate of the junction-based structure may be a metal, an n-type material, or a doped p-type material, with the SBCF being composed of silicon, oxygen, and an alkali metal, which can be deposited on the substrate by known deposition techniques. In addition, the junction-based structure has a low turn-on voltage and low energy consumption.

While particular embodiments, along with specific materials, parameters, etc., have been set forth to exemplify and teach the principles of the invention, such are not intended to be limiting. Modifications and changes may become apparent to those skilled in the art, and it is intended that the invention be limited only by the scope of the appended claims.

What is claimed is:

1. A field emission display, the improvement comprising:

a junction-based field emission structure including a single layer substrate selected from the group consisting of a metal and an n-type material, and a silicon-based compound film region, composed of silicon, oxygen and an alkali metal, deposited on the substrate, said junction-based field emission structure additionally including a layer of Al deposited on one side of said single substrate layer, and a layer of $SiO_2$ insulation located on the opposite side of said single substrate layer, and a plurality of p-Si contacts located in a surface of the opposite side of said single substrate layer.

2. The improvement of claim 1, wherein said alkali metal is selected from the group consisting of Cs, Ba, K, Rb, and Li.

3. The improvement of claim 1, wherein said junction-based field emission structure is connected to a power source for producing a forward bias voltage thereacross.

4. The field emission display of claim 1, wherein said junction-based field emission structure is located in a vacuum case and in spaced relation to a positively biased phosphor screen anode plate, and said junction-based field emission structure is operatively connected to a power supply for producing a forward bias voltage there across.

5. The field emission display of claim 4 additionally includes a switch for shutting off applied electrical potential across said junction-based field emission structure.

6. In a field emission display, the improvement comprising:

a junction-based field emission structure including a single layer substrate, and a silicon-based compound film region, said single layer substrate of said junction-based field emission structure comprising an n-Si layer, a metal contact deposited on one side of said n-Si layer, a plurality of p-Si contacts formed in a surface of an opposite side of said n-Si layers, and a layer of insulation composed of $SiO_2$ on said opposite side of said n-Si layer, intermediate said n-Si layer and said silicon-based compound film region and having openings therein which expose said plurality of p-Si contacts.

7. A junction-based field emission display, comprising:

a vacuum case, a phosphor screen anode plate positioned in said vacuum case and spaced from said anode plate, said junction-based field emission structure consisting of a single layer substrate and a silicon-based compound film region, said junction-based field emission structure additionally including a layer of aluminum deposited on one side of said single substrate layer, and a layer of $SiO_2$ located on the opposite side of said single substrate layer, and a plurality of p-Si contacts located in a surface of the opposite side of said single substrate layer, and means for applying a bias voltage across the junction-based field emission structure, and means for cutting off the bias voltage across the junction-based field emission structure.

8. The display of claim 7, wherein the bias voltage on said anode plate is positive.

9. The display of claim 7, wherein said bias voltage across the junction-based field emission structure is a forward bias voltage, whereby electron transport is from the substrate into the silicon-based compound layer, and electrons are released from said layer into said vacuum case and are accelerated toward said phosphor screen anode plate.

10. The display of claim 9, wherein the forward bias voltage is in the range of 0.5 to 5 volts.

11. The display of claim 7, wherein said substrate is composed of material selected from the group consisting of metals and n-type semiconductors.

12. The display of claim 7, wherein said layer of silicon-based compound is composed of silicon, oxygen, and an alkali metal.

13. The display of claim 12, wherein said alkali metal is selected from the group consisting of Cs, Ba, K, Rb, Li, and other alkali metals.

14. The display of claim 7, wherein said layer of silicon-based compound has a thickness in the range of a few micrometers down to 100 nanometers.

15. The display of claim 7, wherein the layer of silicon-based compound comprises a small band gap, low work function, negative electron affinity material.

16. The display of claim 15, wherein the bias voltage across the layer of silicon-based compound is on the order of half the band gap.

17. A junction-based field emission display, comprising, a vacuum case, a phosphor screen anode plate positioned in said vacuum case, means for applying a bias voltage on said anode plate, a junction-based field emission structure positioned in said vacuum case and spaced form said anode plate, said junction-based field emission structure including a single layer substrate and a silicon-based compound film region, means for applying a bias voltage across the junction-based field emission structure, and means fore cutting off the bias voltage across the junction-based field emission structure, said junction-based field emission structure additionally including a layer of metal deposited on one side of said single substrate layer, and a layer of insulation located on the opposite side of said single substrate layer, and a plurality of p-Si contacts located in a surface of the opposite side of said single substrate layer, said single substrate layer being composed of n-Si, said layer of metal being composed of Al, and said layer of insulation being composed of $SiO_2$.

18. The display of claim 17, wherein said plurality of p-Si contacts includes a dopant of Group II materials, including In, B, and Ga.

* * * * *